United States Patent [19]

Churchill et al.

[11] 4,373,726

[45] Feb. 15, 1983

[54] AUTOMATIC GAMING SYSTEM

[75] Inventors: Richard W. Churchill, Hopkinton; Don W. Hartman, Harvard; Richard A. Howard, Stow, all of Mass.; Victor Markowicz, North Bergen, N.J.

[73] Assignee: Datatrol Inc., Hudson, Mass.

[21] Appl. No.: 180,603

[22] Filed: Aug. 25, 1980

[51] Int. Cl.[3] ..... A63F 7/00

[52] U.S. Cl. ..... 273/138 A; 273/139

[58] Field of Search ..... 273/1 E, 138 A, 139, 273/237, 269

[56] References Cited

U.S. PATENT DOCUMENTS

| | | | |
|---|---|---|---|
| 3,688,276 | 8/1972 | Quinn | 364/200 |
| 3,770,269 | 11/1973 | Elder | 273/1 E |
| 4,087,092 | 5/1978 | Krause et al. | 273/138 A |
| 4,191,376 | 3/1980 | Goldman et al. | 273/139 |
| 4,277,064 | 7/1981 | Newman | 273/138 A |
| 4,299,637 | 11/1981 | Oberdeck et al. | 273/139 |

*Primary Examiner*—Vance Y. Hum

*Assistant Examiner*—Leo P. Picard

*Attorney, Agent, or Firm*—Joseph S. Iandiorio

[57] ABSTRACT

An automatic gaming system employing a plurality of gaming cards used by the players including a card dispensing unit having a card reader for reading from a gaming card a coded representation of the gaming indicia format on the card; a storage device; a circuit for verifying a coded representation; and control generator circuitry responsive to a verified coded representation for assigning a control identification to that card and storing the coded representation and control identification in the storage device and a printer for printing the assigned control identification on the card; and a gaming unit including an input device for entering selected gaming indicia in the storage device; input elements for entering the control identification of an alleged winning card; and a comparator for comparing the entered selected gaming indicia with the gaming indicia format of the alleged winning card to determine if a predetermined pattern of the selected indicia is present on the card format, indicating a winning card.

10 Claims, 9 Drawing Figures

AUTOMATIC GAMING SYSTEM

FIELD OF INVENTION

This invention relates to an automatic gaming system employing a plurality of gaming cards used by the players.

BACKGROUND OF INVENTION

Prevention of revenue losses in public gaming due to errors, mistakes and dishonesty is a major concern among the operators of gaming parlors and the governments who tax the games. For example, in one gaming system the government issues gaming cards for use in bingo or lotto or similar games which cards have various face values. Parlor owners buy these cards at a discount from their face value and then resell them at face value at the gaming parlors. This requires large capital outlay in advance by the parlor owners and also places the burden of lost, destroyed or damaged cards on the parlor owners. The parlor owners may also suffer losses when a player buys more than one card at a time and then turns in only the one that wins and uses the remaining cards for subsequent games. Cheating also occurs when the numbers or other indicia on the card face are covered over with other numbers or indicia or otherwise changed to make the card a bogus winner. In systems where the cards are not sold at face value the government must obtain its tax revenue based on a percentage of the value actually paid for the cards at the parlor. Thus if parlor owners or employees "skim" or do not accurately report all card receipts and winner payouts the government stands to lose.

SUMMARY OF INVENTION

It is therefore an object of this invention to provide a gaming system employing gaming cards used by players which is virtually fully automated and secure against cheating or skimming.

It is a further object of this invention to provide such a gaming system in which the cards are essentially worthless until issued and validated at game time.

It is a further object of this invention to provide such a gaming system in which each card used in a game is uniquely identified so extra cards cannot be introduced.

It is a further object of this invention to provide such a gaming system in which each card used in a game is uniquely identified and specifically associated with the particular format of gaming indicia on its face so that tampering is easily detectable.

It is a further object of this invention to provide such a gaming system in which the total number of cards, their value and the value of the winner's purse is calculated and printed in a report which must be approved to obtain a release code to enable the system to continue to operate.

The invention features an automatic gaming system which employs a plurality of gaming cards used by the players. There is a card dispensing unit and a gaming unit. The card dispensing unit includes means for reading from a gaming card a coded representation of the gaming indicia format on the card. There are also storage means and means for verifying the coded representation. Means responsive to a verified coded representation assign a control identification to the card and store the coded representation and control identification in the storage means. There are means for printing the assigned control identification on the card. The gaming unit includes means for entering selected gaming indicia in the storage means and means for entering the control identification of an alleged winning card. There are means for validating the control identification of the alleged winning card and means for comparing the entered selected gaming indicia with the gaming indicia format of the alleged winning card face to determine if the predetermined pattern of a selected indicia is present on the card format, indicating a winning card.

In a preferred embodiment the invention includes means for setting the value of the card and means for selecting the number of cards to be printed, and storing that information in the storage means. There is means for calculating the value of all the cards printed and the award for a winning card. There is means for designating the end of the game and means responsive to determination of a winning card and to the means for designating the end of the game for printing a game report including the number of cards, card values, and win value for the game. There are also means for indicating the end of a group of games, for example those games played in a single day, and means responsive to the means for designating the end of a game and to the means for designating the end of a group of games for printing a group report including the number of cards and card value for a group of games. There is means for designating the end of a period, for example a week or ten days, of daily games, and means responsive to the means for designating the end of a group of games and the means for designating the end of a period for generating and storing a release code. Means are provided responsive to the means for designating the end of a game period for printing a period report including number of cards, card value, and a validation code. A report memory is used to accumulate the number of groups of games played in a gaming period, and there are means for inhibiting the means for entering selected gaming indicia after a predetermined number of groups of games has been reached. There is also provided means for entering a release code and means for comparing the entered release code with the stored release code and providing a clear signal to the report memory upon a satisfactory comparison to enable the means for inhibiting and permit the means for entering selected gaming indicia to operate. Initializing means are provided for entering into the system the game indicia format on the face of each card together with the control identification of that card.

The invention as thus far described assumes a partially preprinted card but this is not a necessary limitation of the invention. The invention may also include means for generating from its storage means the entire card face, along with the gaming indicia format; and may also include the means for printing the entire card face, along with the gaming indicia format.

The invention also features an automatic gaming method employing a plurality of gaming cards used by the players. A code representation is read from a gaming card which indicates the gaming indicia format on the face of the card. A coded representation read from the card is verified and a control identification is assigned to that card and stored with the coded representation in a storage device. The assigned control identification is also printed on the card. Selected gaming indicia are entered into the storage means, and at some point the control identification of an alleged winning card is entered. The control identification of the alleged winning card is validated and then the gaming indicia which have been thus far selected are compared with the gaming indicia format of the alleged winning card face to determine if a predetermined pattern of the selected indicia is present on the card format indicating a winning card.

DISCLOSURE OF PREFERRED EMBODIMENT

Other objects, features and advantages will occur from the following description of a preferred embodiment and the accompanying drawings, in which.

Figure 1:
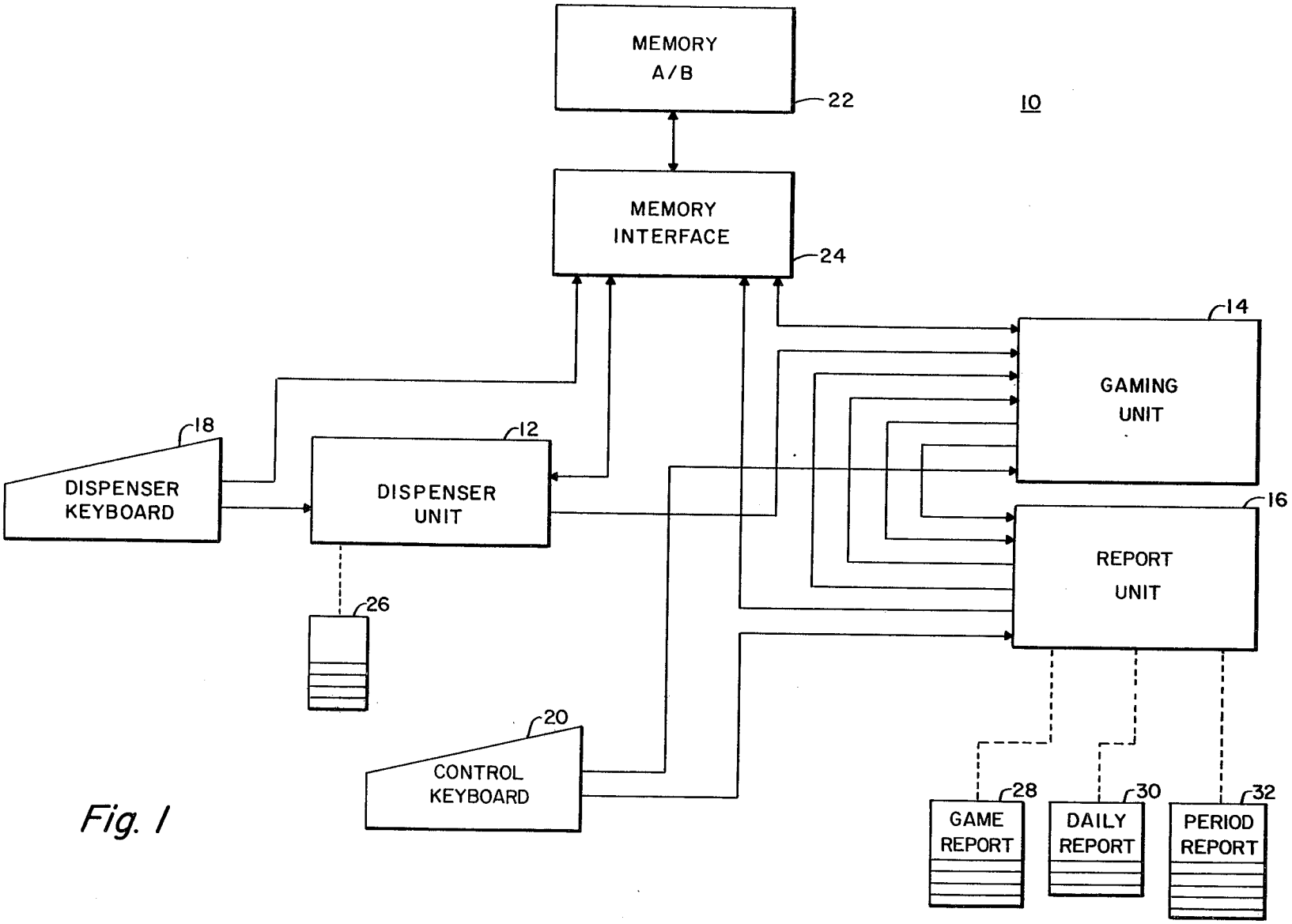
FIG. 1 is a block diagram of an automatic gaming system according to this invention.

There is shown in FIG. 1 an automatic gaming system 10 according to this invention including a dispenser unit 12, gaming unit 14, and report unit 16. Information is manually entered in dispenser unit 12 through dispenser keyboard 18. Information is manually entered into gaming unit 14 and report unit 16 by means of control keyboard 20. Each of the units interconnects with memory 22 through memory interface surface 24. Memory 22 is composed of at least two segments A and B so that while the game is being played through gaming unit 14 interacting with memory segment A, cards 26 for the next game may be issued by dispenser unit 12 interacting with memory segment B. After each game a game report 28 must be printed before the next game can begin. After completion of a group of games, for example all the games played in a single day, a daily report 30 must be printed before the system can begin another game. At the end of a period of gaming, for example a week or ten days, a period report 32 must be generated simultaneously with the internal generation of a special release code. After presentation of the period report to proper authority and approval of the report, a release code is issued, which release code is then entered through control keyboard 20. If it compares favorably with the internally generated release code the gaming system 10 is free to operate for another period.

Figure 2:
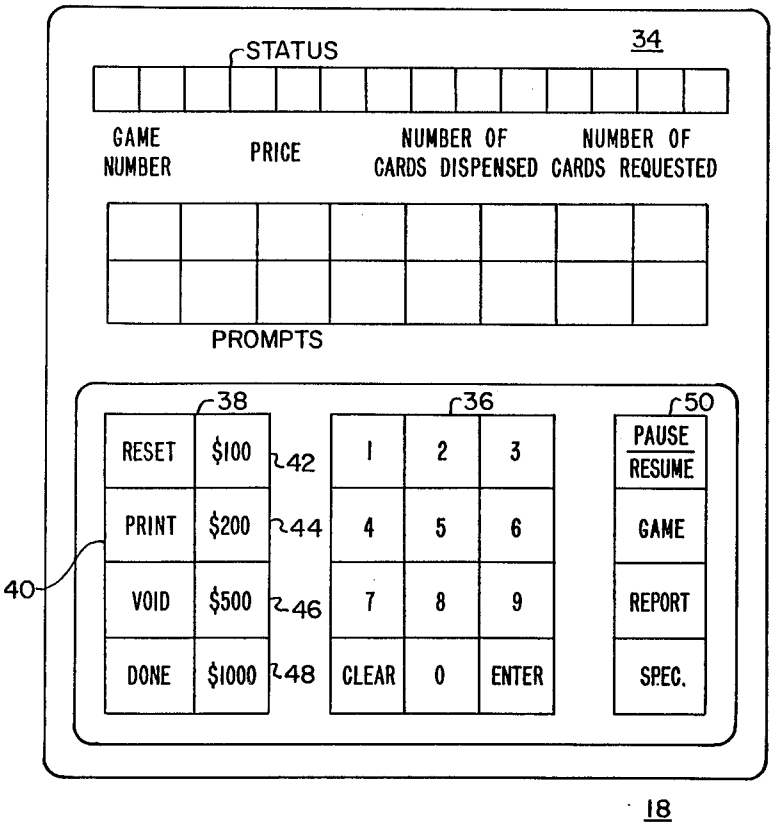
FIG. 2 is an illustration of the dispenser keyboard shown in FIG. 1.

Dispenser keyboard 18 typically includes a display such as light emitting diode (LED) display 34, FIG. 2, and a keyboard including section 36 having numbered keys 0–9 as well as "Clear" and "Enter" keys, and section 38, which includes "Print" key 40 and four keys 42, 44, 46, and 48 which represent four denominations, for example $100, $200, $500, and $1000, respectively, that may be assigned to the cards that are dispensed. Other control keys are shown in section 50 of the keyboard.

Figure 3:
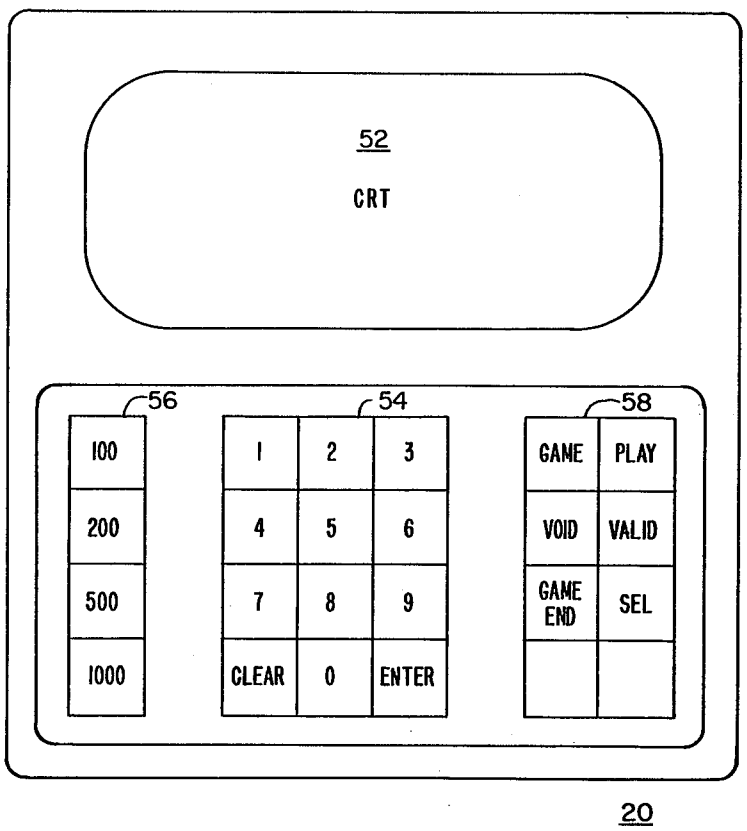
FIG. 3 is an illustration of the control keyboard as shown in FIG. 1.

Control keyboard 20, FIG. 3, similarly includes CRT display 52 and section 54, which is identical to section 36 and has all the same keys. Section 56 includes four keys and indicates the possible denominations of the gaming cards; section 58 includes a number of control keys.

Figure 4:
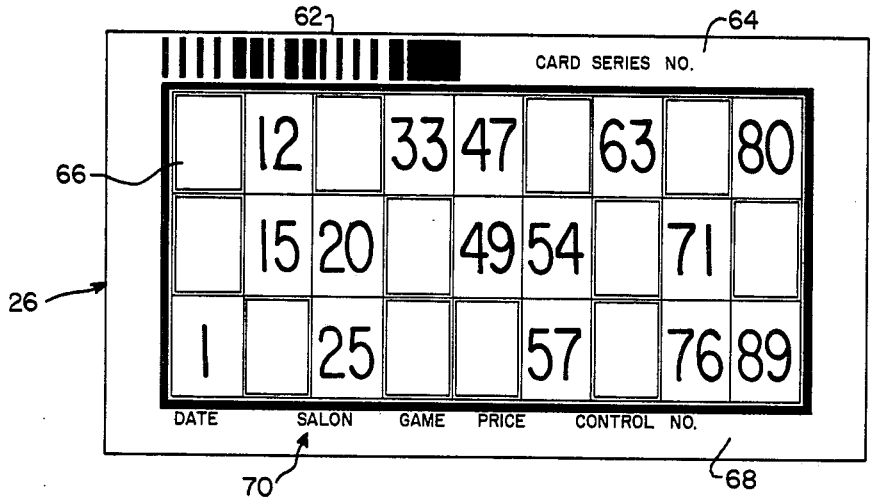
FIG. 4 is an illustration of a gaming card used with the system of FIG. 1.

The gaming card 26 used in the system of this invention includes a bar code 62, FIG. 4, which in coded form contains the card series number 64, also printed on the card. The card number represents the specific numbers and their positions in the three rows and nine columns on the face of the card. After bar code 62 is read by a machine and validated using an internal parity check in the code, a control number is printed on the card at position 68 and the card is issued. Along with the control number, information such as the date, an identification of the salon where the game is being played, the number of the game, and the price or value of the ticket, e.g. $100, $200, $500 or $1000 are also printed along the lower edge of the card, generally shown at 70.

Figure 5:
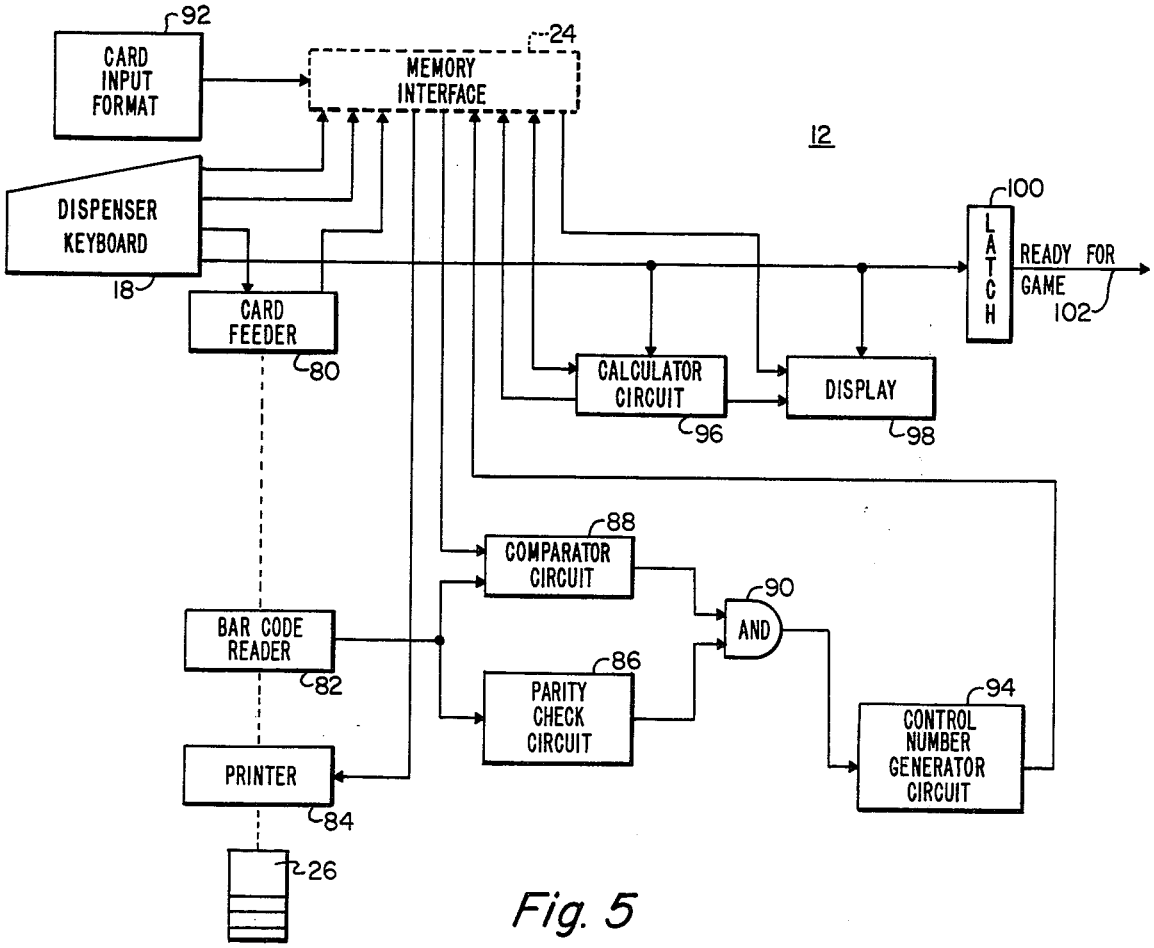
FIG. 5 is a more detailed block diagram of the dispenser unit of FIG. 1.

Dispenser unit 12 includes card feeder 80, FIG. 5, bar code reader 82, and printer 84. The value of the cards to be dispensed is selected using key 42, 44, 46, or 48 on keyboard 18, FIG. 2. The number of cards to be dispensed is selected using the keys of section 36 of keyboard 18. Then the command is given using "Print" key 40, and card feeder 80 feeds a card 26. Bar code reader 82 reads the code 62 from card 26 and provides an input to parity check circuit 86 and comparator circuit 88. If the parity of the card number read from card 26 is correct an input is provided to AND gate 90. The card number is compared with the known card numbers in memory and if a match occurs with one of those numbers a second input to AND gate 90 is provided. Initially, all of the card numbers to be used have been entered via card input format means 92, for example tape or disk storage, along with the specific configuration of the card format. With both approvals, AND gate 90 provides input to control generator circuit 94, which generates a specific control number 68 and enables printer 84 to print that control number along with other information on card 26. Calculator circuit 96 calculates the value of all the tickets sold and then displays it along with the total number of tickets in display 98. Calculator circuit 96 also calculates the value of a win or each type of win; for example in a bingo game it would provide the value of a line win and of a bingo win for the game. After the desired number of cards has been printed, the sale of the cards begins. The cards are initially stacked in the card feeder 80 in sequence according to their card number 64, so that for example card 26 shown in FIG. 4 would be the two hundred sixteenth card dispensed. After the sale of the cards a check is made to determine how many cards are left over. For example, if two hundred fifty cards were dispensed and only two hundred sixteen were sold, there would be an excess of thirty-four issued, valid cards which had not been paid for. At this point the "Void" key in section 38 of keyboard 18, FIG. 2, would be actuated along with the number of the last card sold, for example 216. Then all cards from 217 onward would be voided for this game. After this operation is completed the "Done" key in section 38 is depressed and latch 100 is set to provide the "Ready for Game" signal on line 102.

Figure 6:
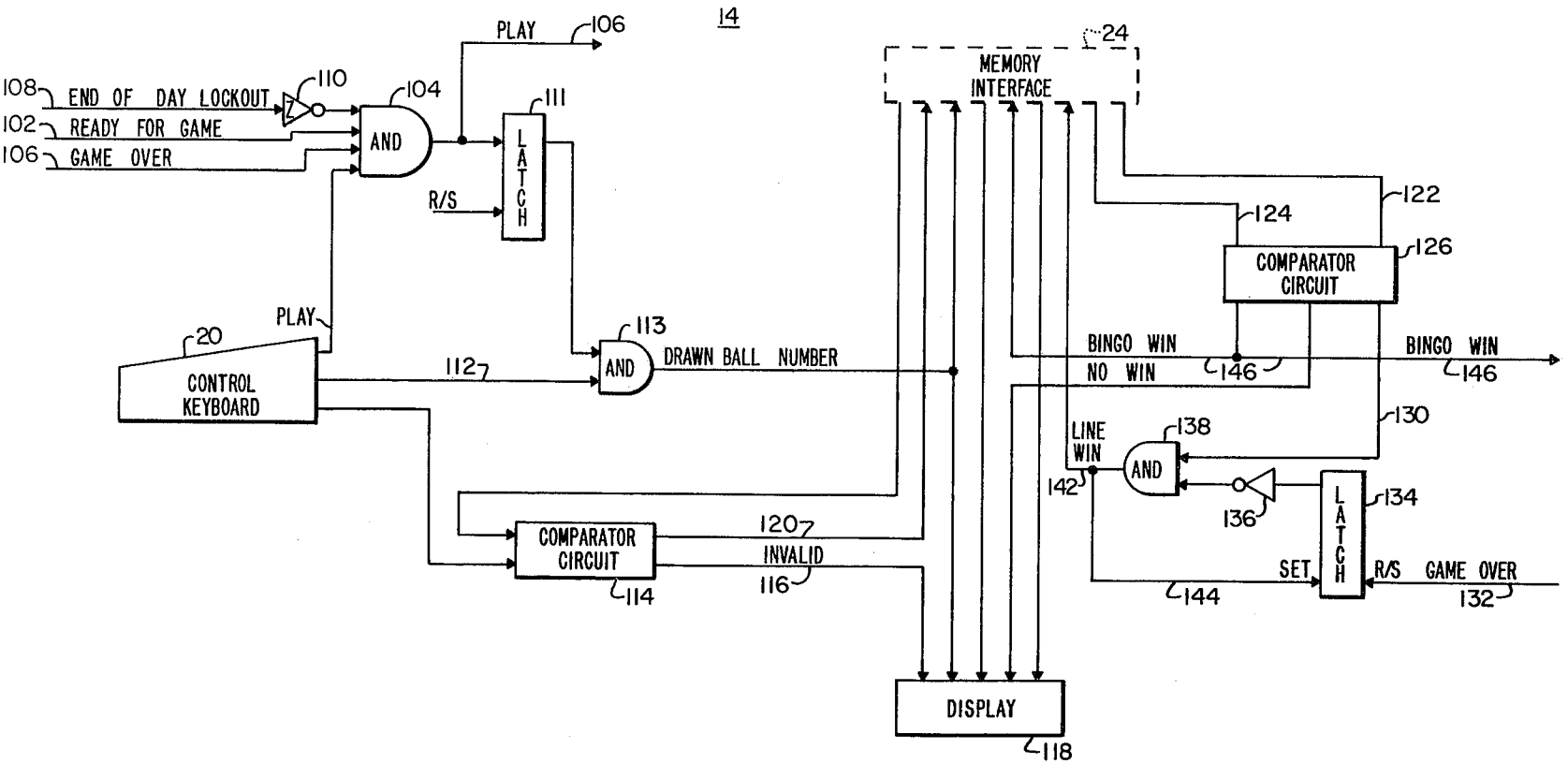
FIG. 6 is a more detailed block diagram of the gaming unit of FIG. 1.

A "Ready for Game" signal is provided on line 102 as one input to AND gate 104 in gaming unit 14, FIG. 6. If AND gate 104 at this time has also received a "Game Over" signal on line 106 indicating that the last game has been completed and has not received on line 108 an "End of Day Lock Out Signal", which is inverted by inverter 110, then AND gate 104 is enabled upon receiving a "Play" command from control keyboard 20 upon actuation of the "Play" key in section 58, FIG. 3. The output from AND gate 104 produces "Play" signal on line 106 and sets latch 111 to enable AND gate 113. Subsequently then as the numbers are drawn to play the game they may be entered one at a time from control keyboard 20 on line 112 through AND gate 113, one number after the other. This may be done by a random selection of one ball at a time from a group of numbered balls, which is accomplished physically in the parlor where the game is played. As the balls are drawn and the numbers entered, the successive numbers are stored in memory.

When a player indicates that he has a line win or a complete card or bingo win and presents his card, the control number is entered via control keyboard 20, and the valid key in section 58 of keyboard 20, FIG. 3, is struck. This causes comparator circuit 114 to check the control number of the alleged winning card with the control numbers stored in memory. If it is an invalid number the signal on line 116 immediately causes that finding to be displayed on display 118. If the alleged winner's control number is not indicated as invalid a signal on line 120 retrieves the specific format designated by the card number associated with that control number on line 122, where it is compared with the ball numbers drawn so far provided on line 124. The comparison takes place in comparator circuit 126, which may indicate "No Win" on line 128 or a "Line Win" on line 130, either of which is immediately displayed in display 118. If the "Game Over" signal is present on line 132, then latch 134 is set and through inverter 136 disables AND gate 138. However, if the game is not over then latch 134 is not set and AND gate 138 is enabled by inverter 136, so that when the "Line Win" indication occurs on line 130 a "Line Win" signal is provided on line 142. The output on line 142 is fed back through line 144 to once again set latch 134. If comparator 126 found a bingo win, or game win, then a signal is provided on line 146.

Figure 7:
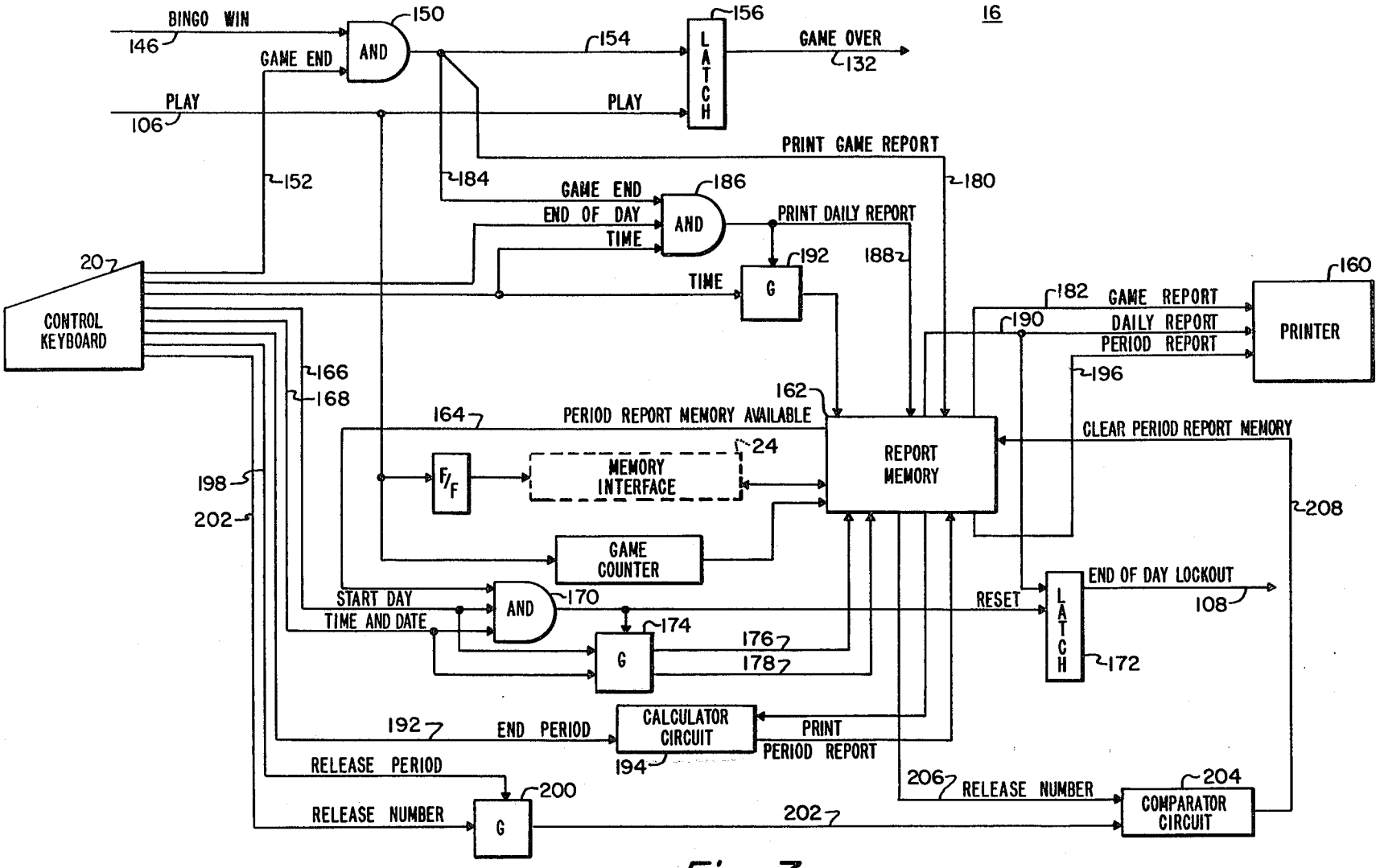
FIG. 7 is a more detailed block diagram of the report unit of FIG. 1.

With the "Bingo Win" signal present on line 146, AND gate 150 in report unit 16, FIG. 7, is enabled upon the receipt of the "Game End" signal on line 152 from control keyboard 20 where it is entered by means of the "Game End" key in section 58, FIG. 3. This provides a signal on line 154, FIG. 7, which operates latch 156 to provide the "Game Over" signal on line 132. Latch 156 is reset by the "Play" signal on line 106. Report unit 16 includes a printer 160 that may be enabled to print, depending upon its input, a game report, a daily report of all the games played that day, or a period report of all games played each day for a number of days. The report memory 162 stores the information to be reported as well as control information. At the start of a new day, if report memory 162 indicates on line 164 that period report memory is available for another day, then with the entry by the operator of the "Start Day" signal on line 166 and the current time and date on line 168, AND gate 170 is enabled to reset latch 172, whereupon the "End of Day" lockout signal goes low on line 108 enabling inverter 110, FIG. 6, to provide the necessary input to AND gate 104 to let the play begin. Simultaneously, the output from AND gate 170 enables gate 174 to pass the "Start of Day" time and date information on lines 176 and 178 to report memory 162. The "Start of Day" signal on line 166 may be entered by pressing the select key, "SEL", followed by pressing the number 1 key.

As each game ends a "Print Game Report" signal on line 180 generated from AND gate 150 is provided to report memory 162, which then generates a "Game Report" signal on line 182 which causes printer 160 to print out the game report. At the end of the last game of a group of games, for example the last game of a day, a "Game End" signal is generated on line 184 from AND gate 150 to provide one input to AND gate 186. At this time the "End of Day" signal may be entered from control keyboard 120 by using the select key, "SEL", and the number 6 followed by the time, so that AND gate 186 has all of its inputs and will provide the "Print Daily" report signal on line 188 to report memory 162, which in turn generates the "Daily Report" signal on line 190 to enable printer 160 to print the daily report of all games. Simultaneously the signal on line 188 enables gate 192 to pass the time to report memory 162. At the end of a period, for example when the signal on line 164 indicates there is no more room available to store game reports, an "End of Period" signal may be entered by pressing the "SEL" key and the number 7 to provide a signal on line 192 to calculator circuit 194. Calculator circuit 194 generates a check number from the data in report memory 162 to be printed in the period report, and also the validation number is printed along with the data in the period report. Also calculated at this time is a release number which is not printed in the period report but is stored in report memory 162. The signal on line 196 then commands printer 160 to print the period report with the validation number.

This report must then be provided to a control agency, for example the taxing authority of a particular government, which checks the data against the encrypted validity code. If the validity code is proper the authority then issues a release number. The operator may then enter the release number by actuating the "SEL" key and the number 8 to provide the "Release" signal on line 198 which enables gate 200 to pass the release number 202 to comparator circuit 204. If the entered release number on line 202 compares favorably with the stored one delivered on line 206, comparator circuit 204 provides the "Clear Period Report Memory" signal on line 208, which once again enables the report memory to accept game reports as indicated by the "Period Report Memory Available" signal on line 164.

The game report typically provides the date of the game and the parlor or salon in which it was played, as well as the game number and the value or quantity of the cards sold for that game. Also provided is the value of a line win, the number of line wins, and the value of a bingo win. The drawn numbers and the sequence in which they were drawn are also provided in the game report. The daily report includes all the information in a game report in consolidated form. In addition, the daily report includes the opening and closing time for the day and the total tax liability, as well as the total revenue from all the games that day. The total number of tickets sold, grouped by value, is provided along with the total number of tickets voided.

The period report provides the period beginning date and ending date, an identification of the salon, and the total tax liability of that salon for that period. The report also includes the number of games played, the number of tickets sold, the number of tickets voided, the total line win values, the total bingo win values, the total revenue, and somewhere in the report the validation code.

Figure 8:
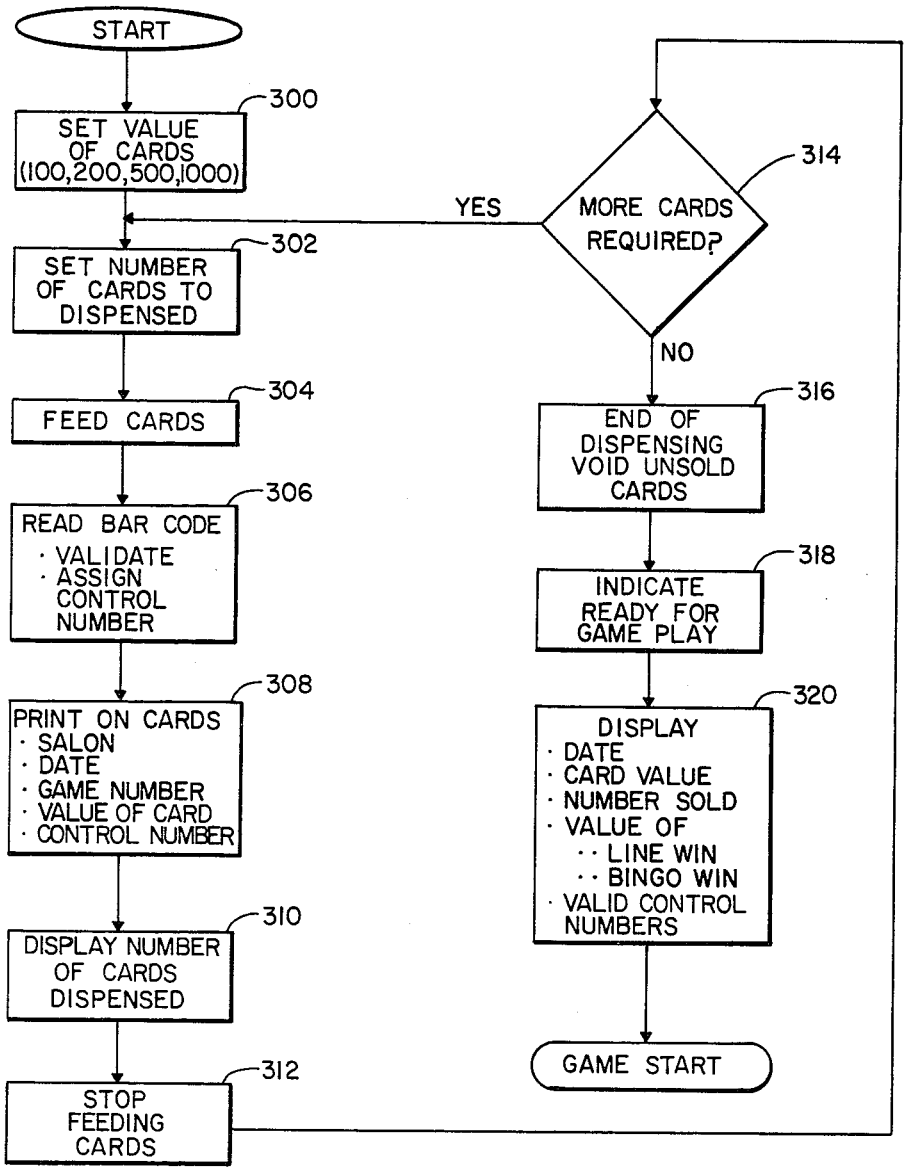
FIG. 8 is a flow chart of card dispensing method according to this invention.

The method of dispensing the cards may be better understood with respect to the flow chart shown in FIG. 8. The value of the card is set in step 300, and then the number of cards to be dispensed is set in step 302. The cards are then fed, 304, to the bar code reader, which reads and validates the bar code and assigns a control number, 306. Next, the cards are printed with the identification of the parlor, the date of the game, the game number, the value of the card, and the control number for the card, 308. The number of cards dispensed is displayed, 310. When the requested number of cards has been dispensed the feeding stops, 312, and the inquiry is made as to whether more cards are required, 314. If more cards are requested the operation begins again at step 302. If no more cards are needed, then the end of the dispensing has arrived and the unsold tickets or cards are voided, 316. An indication is then made that the game is ready to play, 318, and the display of pertinent information 320 may be provided, for example the date, number of cards sold, value of the line win, the bingo win, and the valid control numbers for cards in this game.

Figure 9:
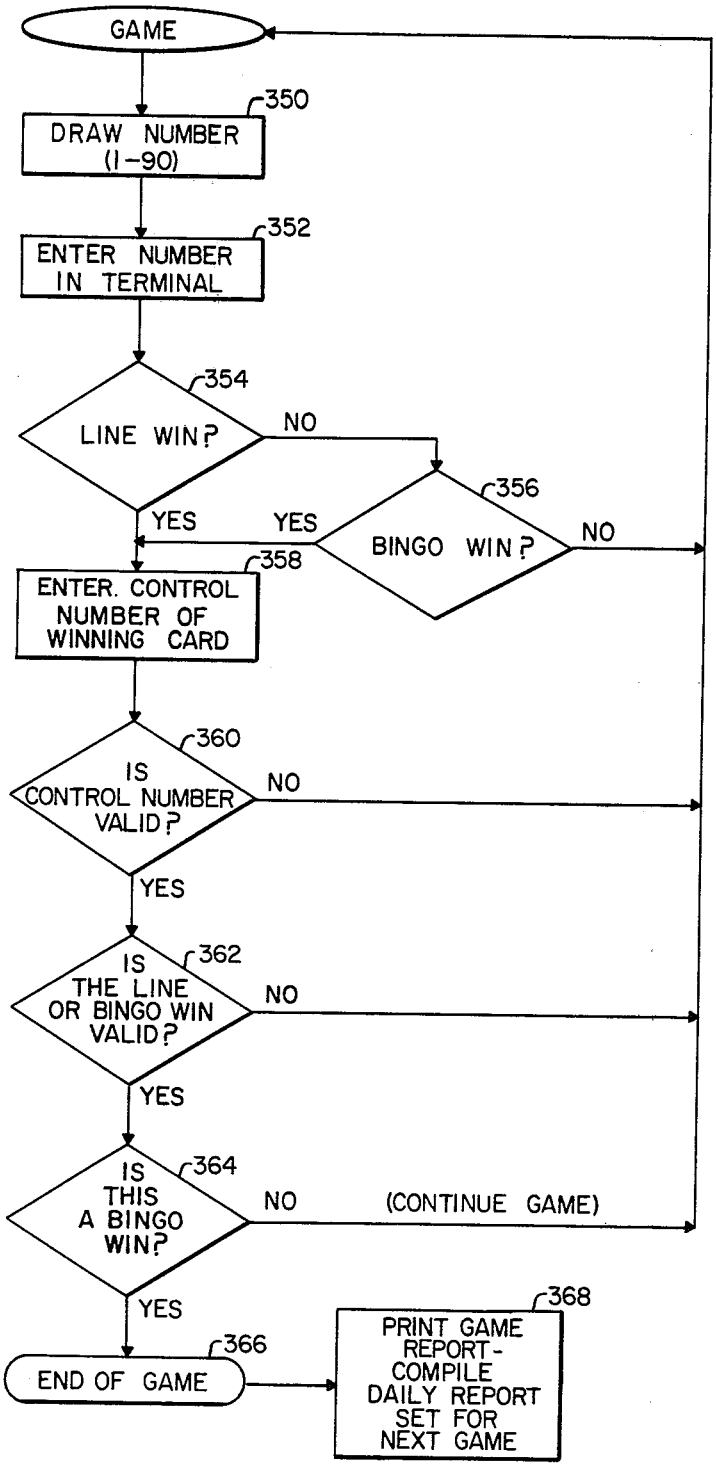
FIG. 9 is a flow chart of the gaming method according to this invention.

The game is played by drawing a number, 350, FIG. 9. For example in a bingo game with a field of numbers from 1 to 90, a number is randomly selected from that set. The selected number is then entered through a terminal 352 and inquiry is made as to whether there is a line win, 354, or a bingo win, 356. An indication that there is neither a line win nor a bingo win recycles the game to step 350, where another number is drawn. Indication that either a line win or a bingo win has occurred requires the entry of the control number of the winning card 358. If the control number is valid, 360, and there is a valid win, 362, then the inquiry is made as to whether this is a bingo win, 364. If it is a bingo win, then the end of the game, 356, has occurred and the game report is printed for this game and the information for the daily report is compiled, 368. At any point if the control number is not valid or the win is not valid, or if there is a line win but not a bingo win, the game is recycled back to step 350, where another number is drawn.

Other embodiments will occur to those skilled in the art and are within the following claims:

What is claimed is:

1. An automatic gaming system employing a plurality of gaming cards used by the players comprising:

a card dispensing unit including means for reading from a gaming card a coded representation of the gaming indicia format on the card;

storage means;

means for verifying the coded representation;

means responsive to a verified coded representation for assigning a control identification to that card and storing said coded representation and control identification in said storage means;

means for printing said assigned control identification on said card; and a gaming unit including means for entering selected gaming indicia in said storage means;

means for entering the control identification of an alleged winning card;

means for validating said control identification of the alleged winning card;

means for comparing the entered selected gaming indicia with the gaming indicia format of the alleged winning card to determine if a predetermined pattern of the selected indicia is present on the card format indicating a winning card;

means for setting the value of the cards and means for selecting the number of cards to be printed and storing that information in said storge means; and means for calculating the value of all cards printed and the award for a winning card.

2. The system of claim 1 further including means for designating the end of a game and means, responsive to determination of a winning card and to said means for designating the end of a game, for printing a game report including number of cards, card value and win value for the game.

3. The system of claim 1 further including means for interconnecting one segment of said storage means with said gaming unit while one game is being played and another segment of said storage means with said dispensing unit during the same game for dispensing cards for the next game.

4. The system of claim 2 further including means for indicating the end of a group of games and means, responsive to said means for designating the end of a game and to said means for designating the end of a group of games, for printing a group report including number of cards and card value for a group of games.

5. The system of claim 2 further including third means for inhibiting said means for entering selected gaming indicia until said game report is printed.

6. The system of claim 4 further including means for designating the end of a period, and means, responsive to said means for designating the end of a group of games and said means for designating the end of a period, for generating and storing a release code.

7. The system of claim 4 further including second means for inhibiting said means for entering selected gaming indicia until said group report is printed.

8. The system of claim 6 further including means, responsive to said means for designating the end of a group of games and to said means for designating the end of a game period, for printing a period report including number of cards, card value, and a validation code.

9. The system of claim 8 further including a report memory for accumulating the number of groups of games played in a gaming period and first means for inhibiting said means for entering selected gaming indicia after a predetermined number of groups of games has been reached.

10. The system of claim 9 further including means for entering a release code, means for comparing said entered release code with said stored release code and providing a clear signal to said report memory upon a satisfactory comparison to enable said means for inhibiting and permit said means for entering selected gaming indicia to operate.

* * * * *